US011345559B2

(12) United States Patent
Fujii

(10) Patent No.: US 11,345,559 B2
(45) Date of Patent: May 31, 2022

(54) SHEET CONVEYANCE DEVICE AND IMAGE FORMING APPARATUS

(71) Applicant: Konica Minolta, Inc., Tokyo (JP)

(72) Inventor: Makoto Fujii, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 214 days.

(21) Appl. No.: 16/592,660

(22) Filed: Oct. 3, 2019

(65) Prior Publication Data

US 2020/0115177 A1 Apr. 16, 2020

(51) Int. Cl.

| | |
|---|---|
| ***B65H 7/14*** | (2006.01) |
| ***B65H 9/00*** | (2006.01) |
| ***B65H 5/06*** | (2006.01) |

(52) U.S. Cl.

CPC ..... *B65H 9/002* (2013.01); *B65H 5/062* (2013.01); *B65H 7/14* (2013.01); *B65H 2404/1441* (2013.01); *B65H 2404/152* (2013.01); *B65H 2404/185* (2013.01); *B65H 2513/10* (2013.01); *B65H 2701/1315* (2013.01)

(58) Field of Classification Search

CPC ..... B65H 2404/152; B65H 2404/1441; B65H 2404/185; B65H 7/14; B65H 9/002; B65H 23/0251; B65H 23/0253

See application file for complete search history.

(56) References Cited

U.S. PATENT DOCUMENTS

| | | | | |
|---|---|---|---|---|
| 6,059,284 | A * | 5/2000 | Wolf | B65H 5/062 271/227 |
| 8,308,160 | B2 * | 11/2012 | Miyazawa | B65H 7/08 271/251 |
| 9,751,708 | B2 * | 9/2017 | Hagihara | B65H 5/064 |
| 10,081,509 | B1 * | 9/2018 | Takashima | B65H 3/56 |
| 2020/0071105 | A1 * | 3/2020 | Okada | B65H 15/004 |

FOREIGN PATENT DOCUMENTS

| | | | | |
|---|---|---|---|---|
| DE | 102010046754 | A1 * | 3/2012 | B65H 23/0251 |
| DE | 102010047256 | A1 * | 4/2012 | B65H 23/0251 |
| JP | 2005-330084 | A | 12/2005 | |
| JP | 2007-276922 | A | 10/2007 | |

* cited by examiner

*Primary Examiner* — Patrick Cicchino

(74) *Attorney, Agent, or Firm* — Squire Patton Boggs (US) LLP

(57) ABSTRACT

There is provided a sheet conveyance device that includes a first conveyance roller and a second conveyance roller that are arranged at a position other than a center in a direction of sheet width in a sheet conveyance path, a roller selector that selects the first conveyance roller or the second conveyance roller as a roller to convey a sheet, and a controller that causes the roller selector to select the first conveyance roller or the second conveyance roller. The first conveyance roller is made of a material that causes a speed of the sheet conveyed by the first conveyance roller in contact with the first conveyance roller to be higher than a rotation speed of the first conveyance roller. The second conveyance roller is made of a material that causes a speed of the sheet conveyed by the second conveyance roller in contact with the second conveyance roller to be lower than a rotation speed of the second conveyance roller.

8 Claims, 17 Drawing Sheets

*FIG. 9*

| | OUTPUT OF SENSOR | | |
|---|---|---|---|
| SHEET DETECTION SENSOR 19A ON FAR SIDE | ON | OFF | OFF |
| SHEET DETECTION SENSOR 19B ON NEAR SIDE | ON | ON | OFF |
| SHEET POSITION | DRAWN TO FAR SIDE | AT OR NEAR CENTER | DRAWN TO NEAR SIDE |

SHEET CONVEYANCE DEVICE AND IMAGE FORMING APPARATUS

BACKGROUND

Technological Field

The present invention relates to a sheet conveyance device and an image forming apparatus.

Description of the Related Art

In conveyance of sheets in an image forming apparatus such as a printer or photocopier, a paper jam or paper damage may be caused when the position of a sheet moves away from the designated position due to a sheet deviation. As a method to correct sheet deviations, the angle of the conveyance roller is modified, or the speed of the conveyance roller is varied in the direction of sheet width so that such sheet deviations are controlled.

For example, there has been known a sheet conveyance device in which the contact pressure of a conveyance roller is varied between opposite sides in the direction of sheet width so that a gap in speed is generated in the direction of sheet width (see Japanese Patent Application Laid-Open Publication No. 2007-276922).

There has been known another image forming apparatus in which the pressure balance of conveyance rollers on sheets in the direction of sheet width is varied so that the conveyance rollers have different sheet feeding amounts in the direction of sheet width (see Japanese Patent Application Laid-Open Publication No. 2005-330084).

However, the conventional technologies described above require multiple driving motors in order to drive multiple conveyance rollers at different rotation speeds and larger and more complicated devices, which results in an increase in cost.

SUMMARY

The present invention is conceived in view of problems in the prior art described above, and an object thereof is controlling the position of a sheet by a simple mechanism.

To achieve at least one of the abovementioned objects, according to a first aspect of the present invention, a sheet conveyance device reflecting one aspect of the present invention includes:

a first conveyance roller and a second conveyance roller that are arranged at a position other than a center in a direction of sheet width in a sheet conveyance path;

a roller selector that selects the first conveyance roller or the second conveyance roller as a roller to convey a sheet; and a controller that causes the roller selector to select the first conveyance roller or the second conveyance roller, wherein the first conveyance roller is made of a material that causes a speed of the sheet conveyed by the first conveyance roller in contact with the first conveyance roller to be higher than a rotation speed of the first conveyance roller, and wherein the second conveyance roller is made of a material that causes a speed of the sheet conveyed by the second conveyance roller in contact with the second conveyance roller to be lower than a rotation speed of the second conveyance roller.

According to a second aspect of the present invention, an image forming apparatus reflecting one aspect of the present invention includes:

the sheet conveyance device described above; and an image forming unit that forms an image on the sheet.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 7A shows a positional relation of a sheet detection sensor and a sheet when an output of the sheet detection sensor is ON.

FIG. 9 shows relations between the sheet position and the output of the sheet detection sensors.

DETAILED DESCRIPTION OF EMBODIMENTS

Hereinafter, one or more embodiments of the present invention will be described with reference to the drawings. However, the scope of the invention is not limited to the disclosed embodiments.

Hereinafter, an embodiment of the sheet conveyance device and the image forming apparatus according to the present invention is described with reference to the drawings. The present invention is not limited to the illustrated examples, though.

[Speed Characteristics of Conveyance Rollers]

First, the speed characteristics of conveyance rollers are described.

Figure 1:
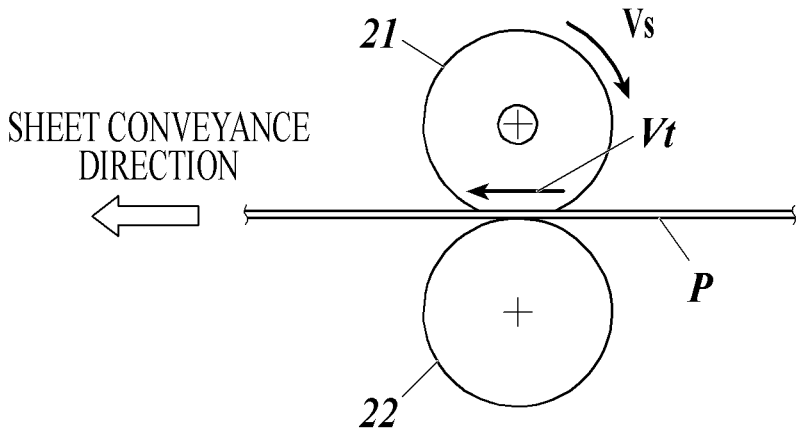
FIG. 1 is a schematic cross-sectional view of a conveyance roller.

FIG. 1 is a schematic cross-sectional view of a conveyance roller 21. The conveyance roller 21, when used, is pressed against a facing roller 22 facing the conveyance roller 21 and drives to rotate on the roller axis. The sheet P is held with the conveyance roller 21 and the facing roller 22 therebetween, and is conveyed while being pressed against the facing roller 22 by the conveyance roller 21.

When the sheet P is conveyed by the conveyance roller 21, the conveyance speed of the sheet P may vary according to the difference in material of the conveyance rollers 21 even in a case where the conveyance rollers 21 rotate at the same speed.

For example, in a case where the conveyance roller 21 is made of incompressible material, the speed of the sheet P which is conveyed by the conveyance roller 21 in pressure contact therewith is higher than the rotation speed of the conveyance roller 21. In a case where the conveyance roller 21 is made of compressible material, the speed of the sheet P which is conveyed by the conveyance roller 21 in pressure contact therewith is lower than the rotation speed of the conveyance roller 21. When the conveyance roller 21 is defined as being "made of incompressible material," it means that at least the outermost layer of the conveyance roller 21 is made of incompressible material, and when the conveyance roller 21 is defined as being "made of compressible material," it means that at least the outermost layer of the conveyance roller 21 is made of compressible material.

As shown in FIG. 1, the rotation speed of the conveyance roller 21, when rotary driving, is referred to as Vs, and the surface speed (the sheet conveyance speed at the nip part) of the conveyance roller 21 which is pressed to the facing roller 22 is referred to as Vt.

Where the conveyance roller 21 is made of incompressible material, $$Vt>Vs.$$

Where the conveyance roller 21 is made of compressible material, $$Vt<Vs.$$

In the present invention, the conveyance speed of the sheet P is controlled to vary in the direction of sheet width by using the gap in the sheet conveyance speed at the nip part caused by the difference in material of the conveyance roller 21. The direction of sheet width is the direction perpendicular to the direction of conveyance of a sheet and horizontal to the surface of the sheet.

An incompressible material is a material with a volume that is barely changeable by compression, and is a rubber material, for example. A compressible material is a material with a volume that is changeable by compression, and is a urethane material, for example.

The characteristics of incompressible materials and compressible materials are discriminated with the Poisson's ratio, whose values range between 0.0 and 0.5. The Poisson's ratio of incompressible materials is around 0.5 while the Poisson's ratio of compressible materials is around 0.0.

An incompressible rubber material with a Poisson ratio of 0.49 is used as an example of incompressible materials, and a compressible rubber material with a Poisson ratio of 0.01 is used as an example of compressible materials.

Figure 2:
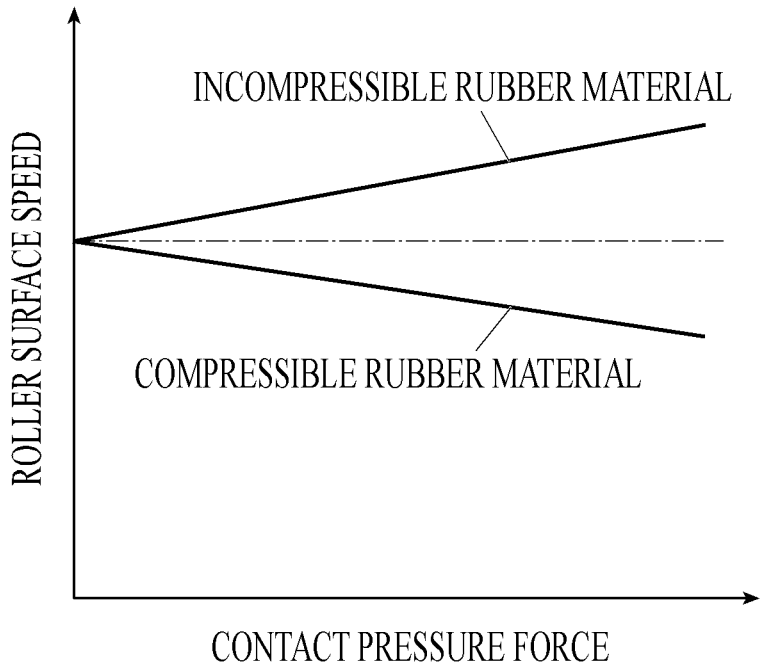
FIG. 2 is a graph showing changes in the surface speed of a conveyance roller of incompressible rubber material and a conveyance roller of compressible rubber material, when the contact pressing force is being varied.

FIG. 2 is a graph showing changes in the surface speed of the conveyance rollers 21, one of which is a conveyance roller 21 made of incompressible rubber material (with a Poisson ratio of 0.49) and the other one of which is a conveyance roller 21 made of compressible rubber material (with a Poisson ratio of 0.01), when the contact pressing force is varied. A silicone rubber is used as the incompressible rubber material, and a urethane foam rubber as the compressible rubber material.

The larger the contact pressing force is, the higher is the surface speed of the conveyance roller 21 of incompressible rubber material.

The larger the contact pressing force is, the lower is the surface speed of the conveyance roller 21 of compressible rubber material.

As shown in FIG. 2, the surface speed of the conveyance roller 21 may be higher or lower depending on the material of the conveyance roller 21, despite the contact pressing force being equal. It is also shown that the surface speed of the conveyance roller 21 is varied according to the contact pressing force of the conveyance roller 21. That is, an extent to which the surface speed of the conveyance roller 21 gets higher or lower can be changed by changing the contact pressing force of the conveyance roller 21.

First Embodiment

Next, the first embodiment of the image forming apparatus according to the present invention is described.

Figure 3:
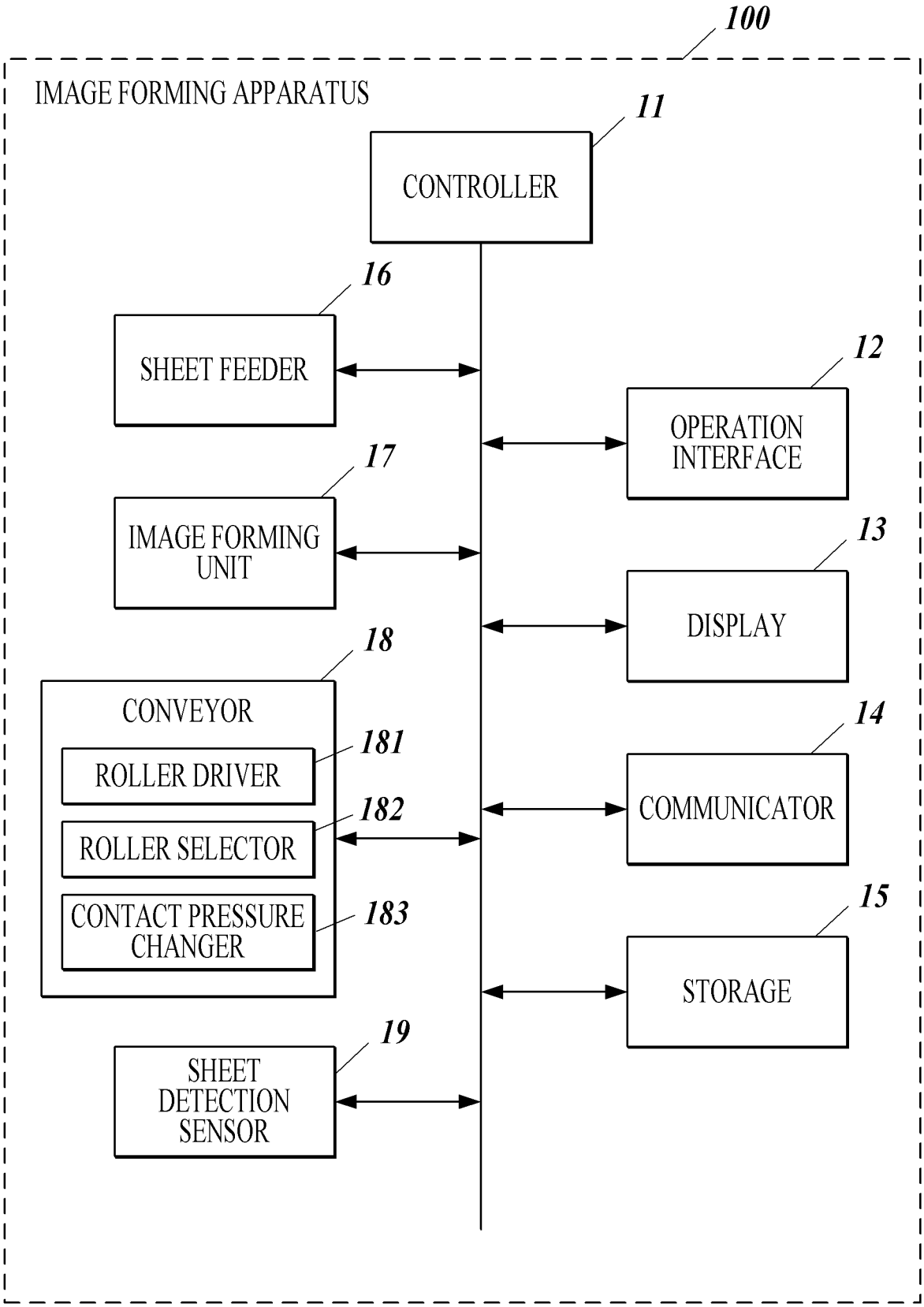
FIG. 3 is a block diagram showing a functional configuration of an image forming apparatus in the first embodiment.

FIG. 3 is a block diagram showing a functional configuration of the image forming apparatus 100 in the first embodiment.

As shown in FIG. 3, the image forming apparatus 100 includes a controller 11, an operation interface 12, a display 13, a communicator 14, a storage 15, a sheet feeder 16, an image forming unit 17, a conveyor 18, a sheet detection sensor 19, etc.

The controller 11 is configured as a CPU (Central Processing Unit), a ROM (Read Only Memory), a RAM (Random Access Memory), etc. and integrally controls the operations of each component of the image forming apparatus 100. The CPU reads out various kinds of processing programs stored in the ROM, loads them in the RAM, and executes various kinds of processing according to the loaded programs.

The operation interface 12 includes a touch panel which is formed to cover the display screen of the display 13, and various operation buttons such as number buttons and a start button. The operation interface 12 outputs operation signals to the controller 11 according to user operations.

The display 13, which is configured as an LCD (Liquid Crystal Display), displays various screens according to commands of display signals input via the controller 11.

The communicator 14 sends and receives data to and from an external device(s) connected to a communication network. For example, the communicator 14 receives image data on an image to be formed from the external device(s).

The storage 15, which is configured as a memory device such as a non-volatile semiconductor memory and a hard disk, stores data concerning various kinds of processing therein.

The sheet feeder 16 provides sheet P to the image forming unit 17. In the embodiment, a continuous sheet is used as the sheet P. For example, the sheet feeder 16 may rotatably hold a roll of continuous sheet which is wound around a supporting shaft, or hold a fanfold continuous sheet.

The image forming unit 17 forms an image(s) on the sheet P on the basis of the image data. The image forming unit 17 is not particularly limited, and may be of, for example, the electrophotographic type or the inkjet type.

The conveyor 18 is a mechanism to convey the sheet P in the image forming apparatus 100, which includes multiple conveyance rollers. The conveyor 18 conveys the sheet P from the sheet feeder 16 to the image forming unit 17 with the multiple conveyance rollers, conveys the sheet P during and after the image forming, and conveys the sheet P out of the image forming apparatus 100.

The conveyance rollers used for the sheet deviation control among the multiple conveyance rollers are referred to as the "conveyance rollers 21." The reference signs of the conveyance rollers 21 such as "21A and 21B" may be used to distinguish one from another. The conveyance rollers 21 are arranged between the sheet feeder 16 and the image forming unit 17, for example.

Figure 4A:
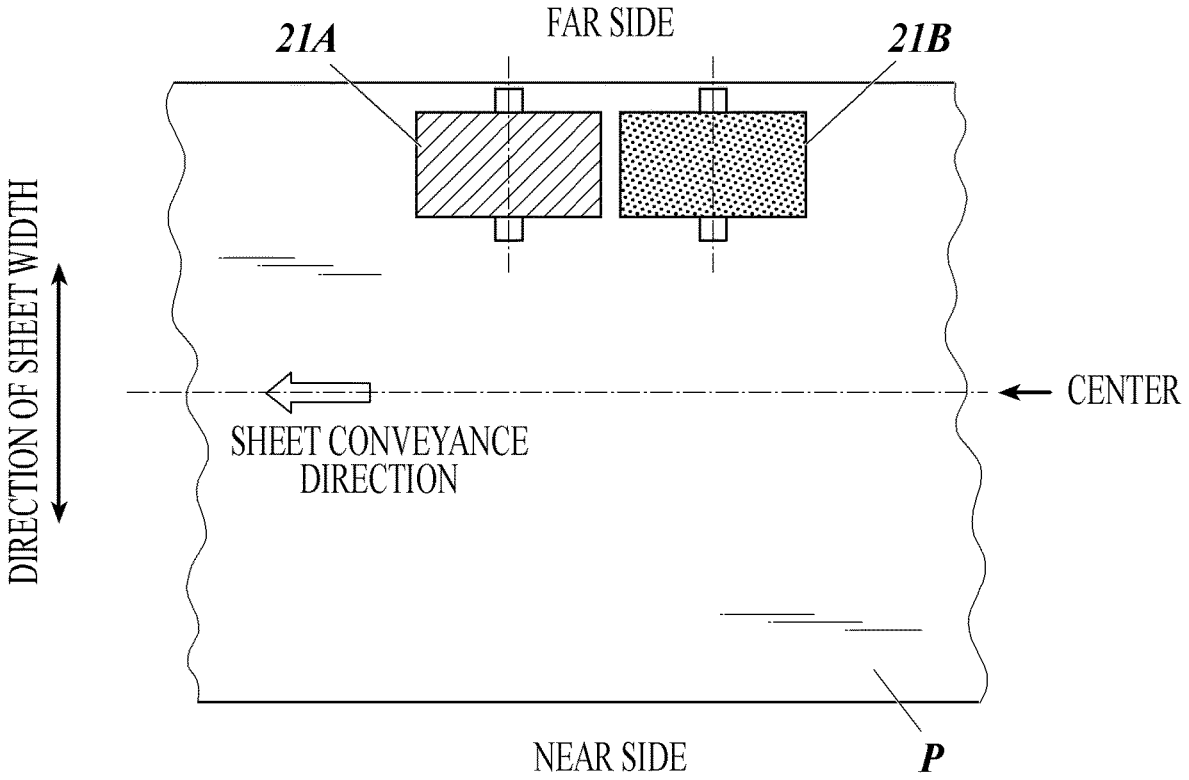
FIG. 4A is a schematic top view of the conveyance rollers used for sheet deviation control.
Figure 4B:
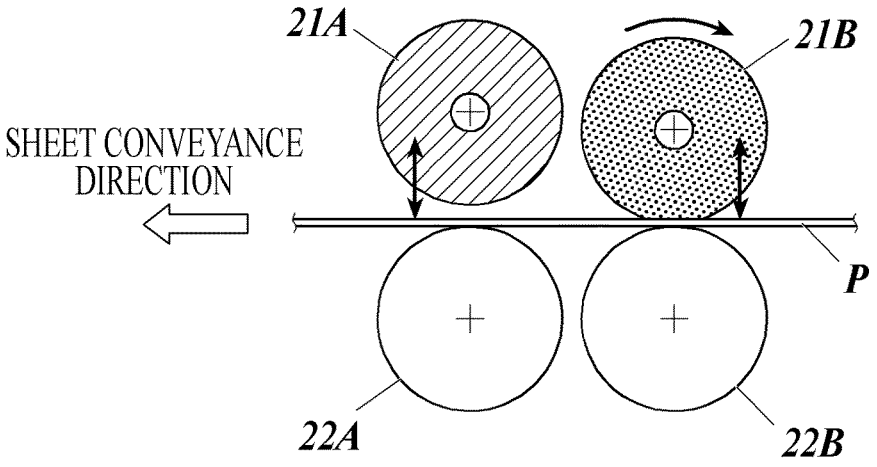
FIG. 4B is a schematic cross-sectional view of the conveyance rollers.

FIG. 4A is a schematic top view of the conveyance roller 21A and the conveyance roller 21B used for the sheet deviation control. FIG. 4B is a schematic cross-sectional view of the conveyance roller 21A and the conveyance roller 21B.

The conveyance roller 21A and the conveyance roller 21B are arranged in the sheet conveyance path at a position farther than the center in the direction of sheet width. The conveyance roller 21A and the conveyance roller 21B are preferably arranged near the end of a sheet in the direction of sheet width. The conveyance roller 21A and the conveyance roller 21B are drive rollers that are rotated by a driver.

The conveyance roller 21A is the first conveyance roller which is made of a material (an incompressible rubber material) which causes the sheet P to be conveyed by the conveyance roller 21A in contact therewith at a speed higher than the rotation speed of the conveyance roller 21A.

The conveyance roller 21B is the second conveyance roller which is made of a material (a compressible rubber material) which causes the sheet P to be conveyed by the conveyance roller 21B in contact therewith at a speed lower than the rotation speed of the conveyance roller 21B.

As shown in FIG. 4B, the facing roller 22A faces the conveyance roller 21A across the sheet conveyance path, and the facing roller 22B faces the conveyance roller 21B across the sheet conveyance path.

The conveyance roller 21A is, when used, pressed against the facing roller 22A.

The conveyance roller 21B is, when used, pressed against the facing roller 22B. In FIG. 4B, the conveyance roller 21B is pressed against the facing roller 22B.

Figure 5A:
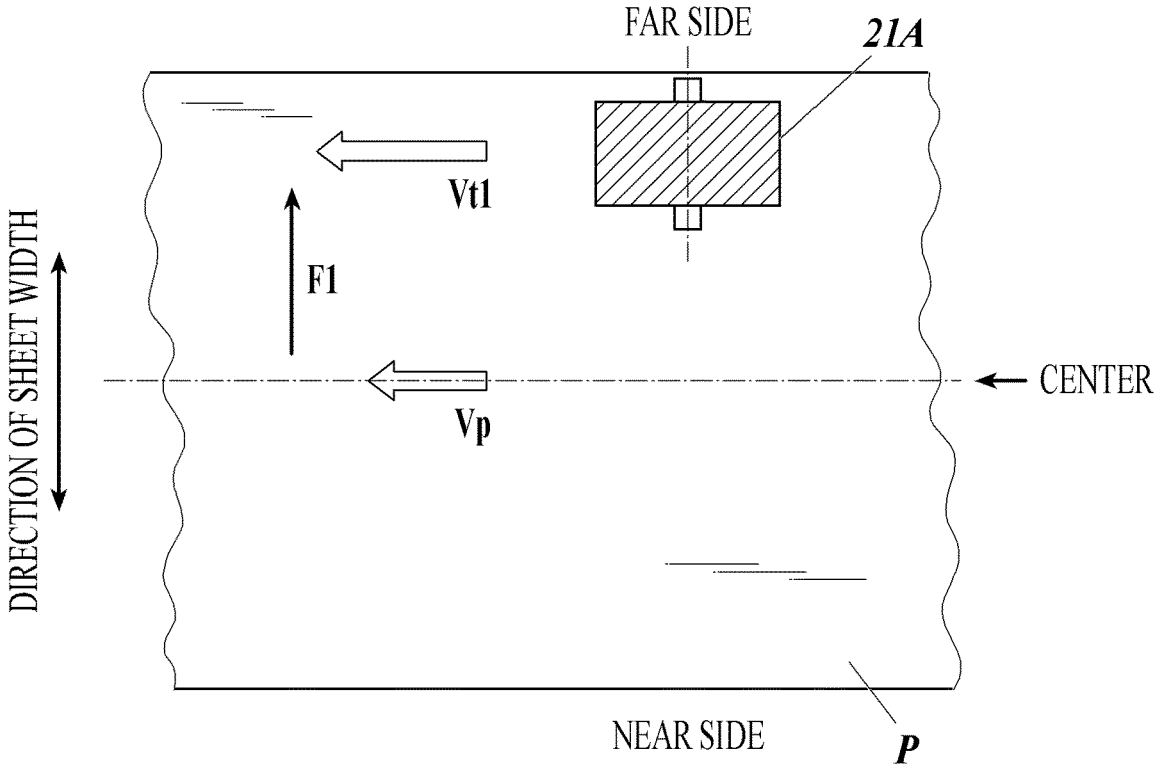
FIG. 5A shows a state where a rotation driving force is applied to the conveyance roller of incompressible rubber material.

FIG. 5A shows a state where the rotation driving force which causes the conveyance roller 21A to rotate at the rotation speed Vp is applied to the conveyance roller 21A made of incompressible rubber material while the sheet P (continuous sheet) is being conveyed at the speed Vp.

Where the surface speed of the conveyance roller 21A which is pressed to the facing roller 22A is Vt1, the speed relation is $$Vt1>Vp.$$

As the sheet P (continuous sheet) is pulled to the side where the speed is higher, a force F1 toward the far side in the direction of sheet width is produced on the sheet P. Accordingly, the sheet P shifts to the far side.

Figure 5B:
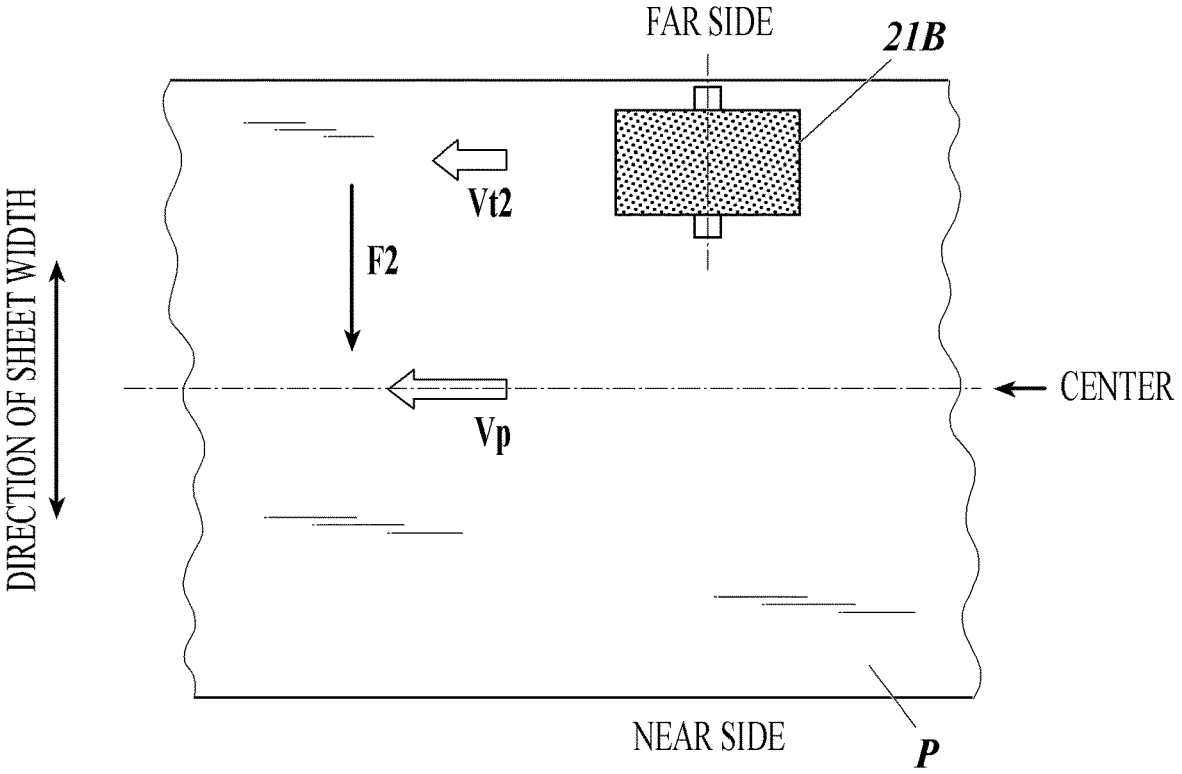
FIG. 5B shows a state where a rotation driving force is applied to the conveyance roller of compressible rubber material.

FIG. 5B shows a state where the rotation driving force which causes the conveyance roller 21B to rotate at the rotation speed Vp is applied to the conveyance roller 21B made of compressible rubber material while the sheet P (continuous sheet) is being conveyed at the speed Vp.

Where the surface speed of the conveyance roller 21B which is pressed to the facing roller 22B is Vt2, the speed relation is $$Vt2<Vp.$$

As the sheet P (continuous sheet) is pulled to the side where the speed is higher, a force F2 toward the near side in the direction of sheet width is produced on the sheet P. Accordingly, the sheet P shifts to the near side.

The conveyor 18 includes a roller driver 181, a roller selector 182, a contact pressure changer 183.

The roller driver 181 rotary drives each of the conveyance rollers of the conveyor 18.

The roller selector 182 selects the conveyance roller 21A or the conveyance roller 21B as a roller to convey the sheet P for the sheet deviation control. The roller selector 182 is capable of individually pressing or separating the conveyance rollers 21A and 21B.

The contact pressure changer 183 changes the contact pressing force for pressing the conveyance roller 21A and the conveyance roller 21B respectively against the facing rollers 22A and 22B. The contact pressure changer 183 changes the contact pressing force of the conveyance rollers 21A or 21B selected by the roller selector 182 against the facing rollers 22A or 22B.

Figure 6:
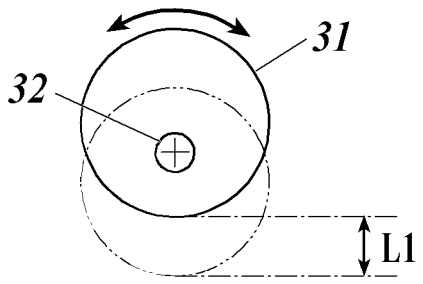
FIG. 6 shows a configuration of an eccentric cam.

An eccentric cam 31 shown in FIG. 6 is used as the roller selector 182 and the contact pressure changer 183, for example. The eccentric cam 31 is rotated on the axis 32, and the lowest position of the eccentric cam 31 is changed in the range of L1. The roller selector 182 and the contact pressure changer 183 are realized by the eccentric cam 31 which presses the roller shafts of the conveyance rollers 21A and 21B at the lowest part of the eccentric cam 31.

Alternatively, the roller selector 182 and the contact pressure changer 183 may be realized by a solenoid which presses the roller shafts of the conveyance rollers 21A and 21B.

The roller selector 182 and the contact pressure changer 183 may be realized by individual mechanisms.

The sheet detection sensor 19 is arranged in the sheet conveyance path to detect presence or absence of the sheet P and output the detection results to the controller 11. With the knowledge of the width of the conveying sheet P, it is possible to determine the position of the entire sheet P by detecting the position of an edge in the width direction of the sheet P. The sheet detection sensor 19 functions as a sheet position detector which detects the position of the sheet P in the direction of sheet width.

Figure 7A:
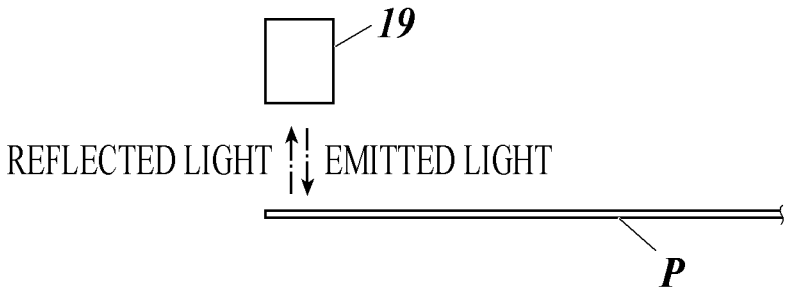
Figure 7B:
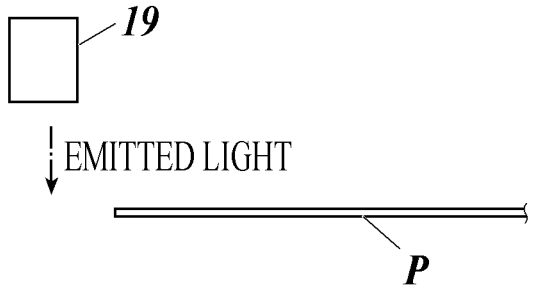
FIG. 7B shows a positional relation of the sheet detection sensor and the sheet when an output of the sheet detection sensor is OFF.

An optical sensor may be used as the sheet detection sensor 19, for example. The sheet detection sensor 19 includes a light emitter and a light receiver on the side facing the sheet P. As shown in FIG. 7A, in a case where light emitted by the light emitter is reflected on the sheet P and reflected light is received by the light receiver, the sheet detection sensor 19 outputs ON (sheet present). As shown in FIG. 7B, in a case where light emitted by the light emitter is not reflected on the sheet P and no reflected light is received by the light receiver, the sheet detection sensor 19 outputs OFF (no sheet).

In this embodiment, the position of the sheet P in the direction of sheet width is regarded as "drawn to the far side," "at or near the center," and "drawn to the near side," using two sheet detection sensors 19A and 19B.

Figure 8A:
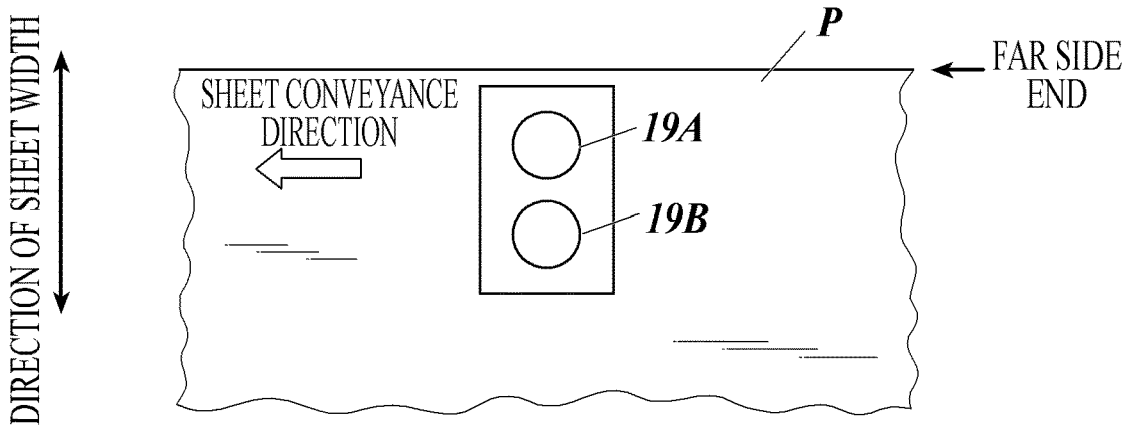
FIG. 8A shows a positional relation of the sheet detection sensor and the sheet drawn to the far side.
Figure 8B:
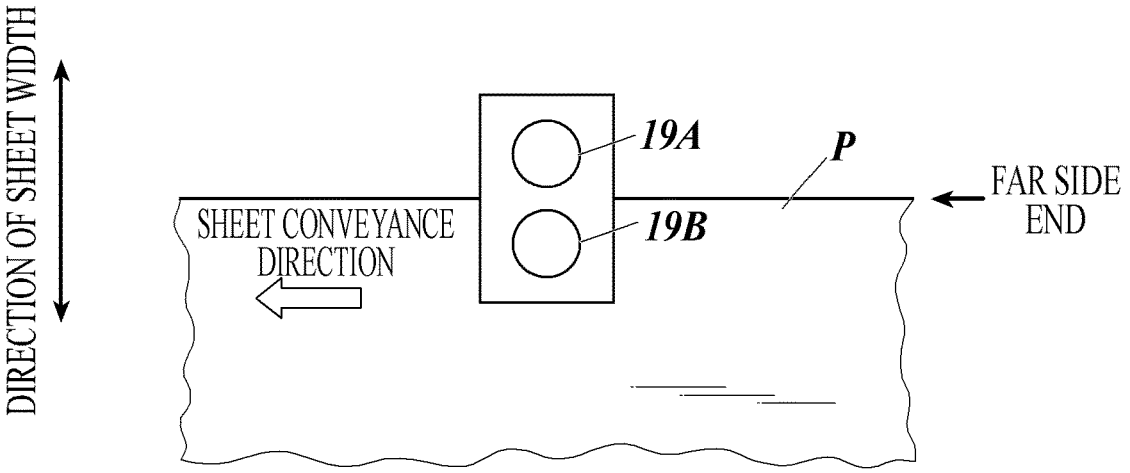
FIG. 8B shows a positional relation of the sheet detection sensor and the sheet at or near the center.
Figure 8C:
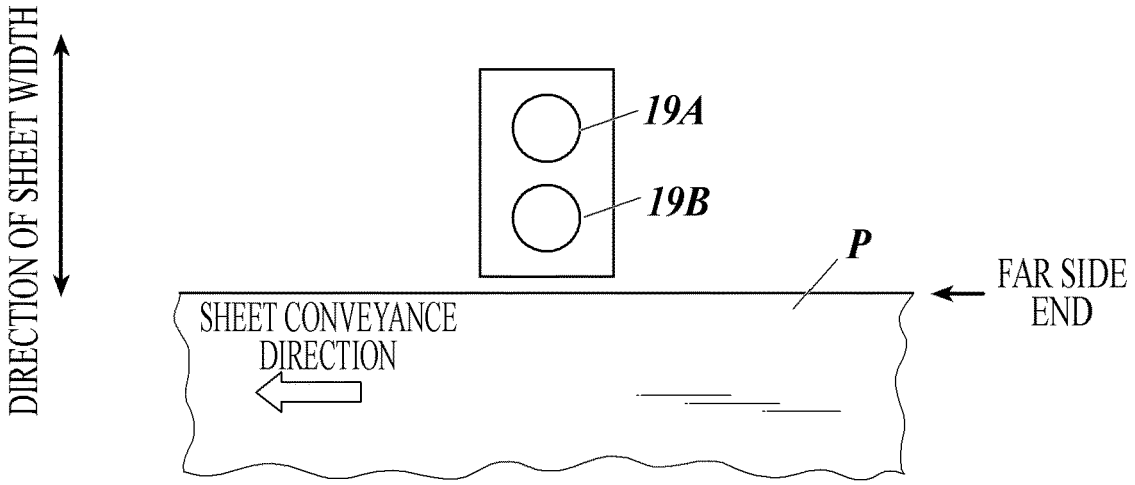
FIG. 8C shows a positional relation of the sheet detection sensor and the sheet drawn to the near side.

As shown in FIGS. 8A to 8C, the sheet detection sensors 19A and 19B are arranged at or near the end on the far side in the direction of sheet width, spaced at a predetermined interval in the direction of sheet width.

FIG. 8A shows a positional relation of the sheet P drawn to the far side and the sheet detection sensors 19A and 19B. In this state, the edge on the far side of the sheet P is on the side farther than the sheet detection sensor 19A.

FIG. 8B shows a positional relation of the sheet P at or near the center and the sheet detection sensors 19A and 19B. In this state, the edge on the far side of the sheet P is located between the sheet detection sensor 19A and the sheet detection sensor 19B.

FIG. 8C shows a positional relation of the sheet P drawn to the near side and the sheet detection sensors 19A and 19B. In this state, the edge on the far side of the sheet P is on the side nearer than the sheet detection sensor 19B.

FIG. 9 shows relations between the sheet position and the output (ON/OFF) of the sheet detection sensors 19A and 19B. In a case where the sheet P is drawn to the far side, both the sheet detection sensors 19A and 19B are "ON." In a case where the sheet P is at or near the center, the sheet detection sensor 19A is "OFF," and the sheet detection sensor 19B is "ON." In a case where the sheet P is drawn to the near side, both the sheet detection sensors 19A and 19B are "OFF."

The controller 11 causes the roller selector 182 to select the conveyance roller 21A or the conveyance roller 21B on the basis of the position of the sheet P detected by the sheet detection sensors 19A and 19B.

Next, the operations in the image forming apparatus 100 is described.

Figure 10:
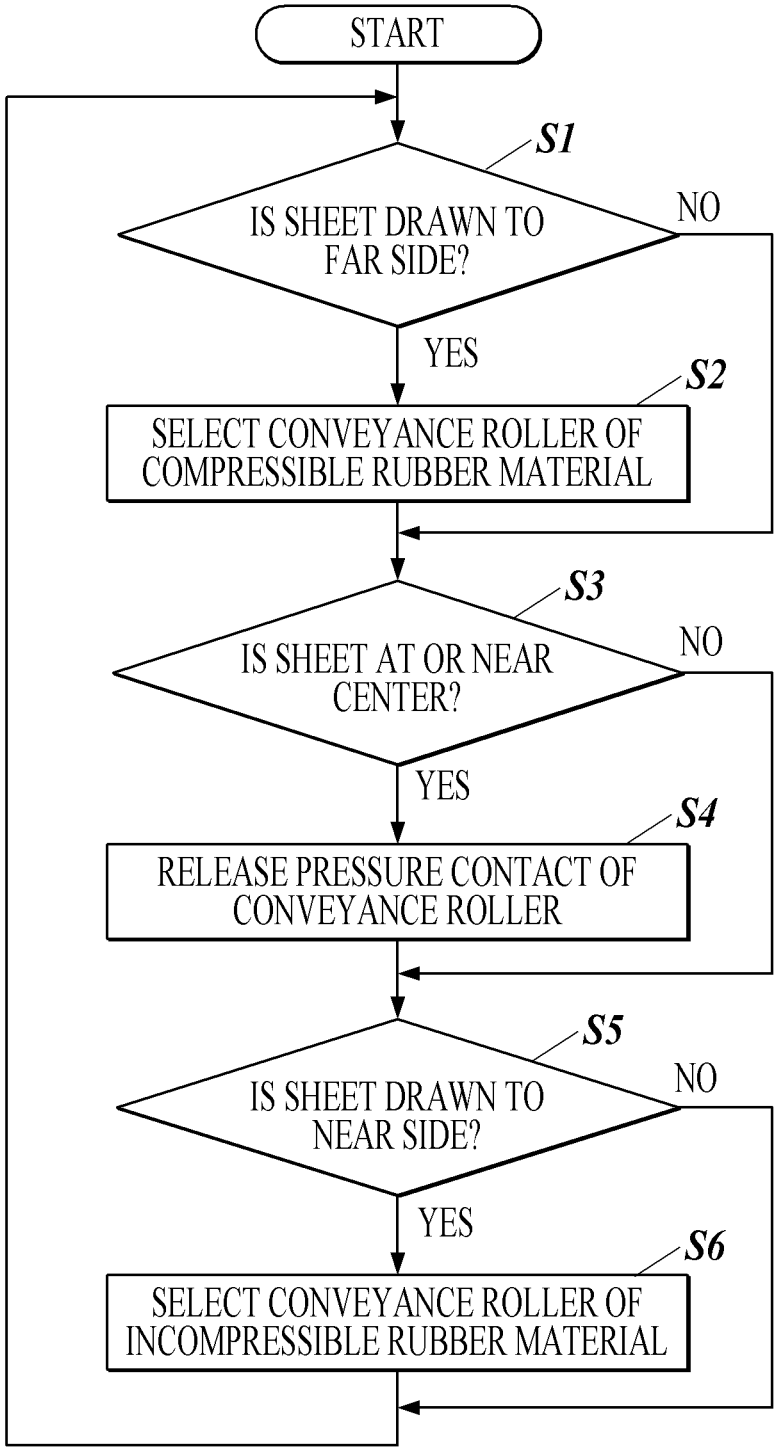
FIG. 10 is a flow chart of the first sheet deviation control processing executed by the image forming apparatus in the first embodiment.

FIG. 10 is a flow chart of the first sheet deviation control processing executed by the image forming apparatus 100.

First, the controller 11 determines whether or not the sheet is drawn to the far side on the basis of the output of the sheet detection sensors 19A and 19B (Step S1). Specifically, if both the sheet detection sensors 19A and 19B are "ON," the controller 11 determines that the sheet is drawn to the far side.

If the sheet is drawn to the far side (Step S1; YES), the controller 11 controls the roller selector 182 to select the conveyance roller 21B of compressible rubber material (Step S2). As the conveyance roller 21B is pressed against the facing roller 22B and the sheet P is conveyed by rotation of the conveyance roller 21B, the sheet P is moved toward the near side in the direction of sheet width (see FIG. 5B).

After performing Step S2, or if the sheet is not drawn to the far side or at Step S1 (Step S1; NO), the controller 11 determines whether or not the sheet is at or near the center on the basis of the output of the sheet detection sensors 19A and 19B (Step S3). Specifically, if the sheet detection sensor 19A is "OFF" and the sheet detection sensor 19B is "ON," the controller 11 determines that the sheet is at or near the center.

If the sheet is at or near the center (Step S3; YES), the controller 11 controls the roller selector 182 to release pressure contact of the conveyance rollers 21A and 21B (Step S4). Instead of separating the conveyance rollers 21A and 21B away, the controller 11 may cause them to be in a slightly pressed state which does not generate a gap in speed in the direction of sheet width.

After performing Step 4, or if the sheet is not at or near the center at Step S3 (Step S3; NO), the controller 11 determines whether or not the sheet is drawn to the near side on the basis of the output of the sheet detection sensors 19A and 19B (Step S5). Specifically, if both the sheet detection sensors 19A and 19B are "OFF," the controller 11 determines that the sheet is drawn to the near side.

If the sheet is drawn to the near side (Step S5; YES), the controller 11 controls the roller selector 182 to select the conveyance roller 21A of incompressible rubber material (Step S6). As the conveyance roller 21A is pressed against the facing roller 22B and the sheet P is conveyed by rotation of the conveyance roller 21A, the sheet P moves toward the far side in the direction of sheet width (see FIG. 5A).

After performing Step S6, or if the sheet is not drawn to the near side at Step S5 (Step S5; NO), the process is returned to Step S1 and repeated.

As described above, in the first embodiment, the conveyance roller 21A of incompressible rubber material and the conveyance roller 21B of compressible rubber material are arranged at positions other than the central part in the direction of sheet width (at an end on the far side in the first embodiment) and either one of the conveyance rollers 21A and 21B is caused to convey the sheet P while pressing it. This can generate a gap in speed of the sheet P in the direction of sheet width and a resultant force to shift the sheet P in the direction of sheet width. With the conveyance rollers 21A and 21B of different materials (with different speed characteristics), the position of the sheet P in the width direction may be controlled by a simple mechanism, as described above.

The rotation speed of the conveyance rollers 21A and 21B may be the same, and there is no need to include multiple driving motors to rotary drive the conveyance rollers 21A and 21B.

As the conveyance roller 21A or the conveyance roller 21B is selected on the basis of the position of the sheet P detected by the sheet detection sensors 19A and 19B, the position of the sheet P in the direction of sheet width may be controlled according to the deviation of the sheet P (to which side the sheet P is deviated in the direction of sheet width).

By changing the materials of the conveyance rollers 21, the conveyance rollers 21 can be configured to have a surface speed at the nip part that is higher or lower than the original sheet conveyance speed, and a gap between the original sheet conveyance speed and the surface speed of the conveyance roller 21 at the nip part can be kept small. Thus, load is not applied to any other sheet conveyance mechanism, and the sheet itself is not subject to excessive stress.

Figure 11:
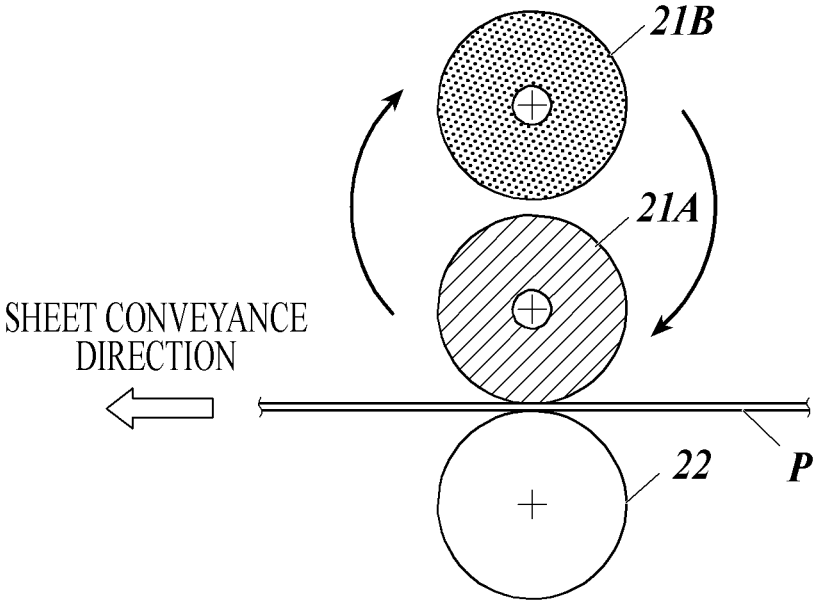
FIG. 11 is an explanatory drawing of another mechanism to select a conveyance roller from conveyance rollers with different speed characteristics.

The mechanism which enables the roller selector 182 to select the conveyance roller 21A or 21B is not limited to the examples described above. For example, as shown in FIG. 11, a common facing roller 22 may be provided for the conveyance roller 21A and 21B, and the roller selector 182 may select the conveyance roller 21A or 21B by changing the positions of the conveyance rollers 21A and 21B with each other.

Second Embodiment

Next, the second embodiment of the present invention is described.

The image forming apparatus in the second embodiment is configured similarly to the image forming apparatus 100 in the first embodiment except for the sheet detection sensors 19. Thus, the common components are labelled with the same reference signs, and descriptions thereof are omitted. Hereinafter, the configuration and processing specific to the second embodiment are described.

In the first embodiment, presence or absence of the sheet P is detected at two points (sheet detection sensors 19A, 19B). On the other hand, in the second embodiment, the sheet detection sensors 19 detect presence and absence of the sheet P at more points in the direction of sheet width to detect the position of the sheet P in the direction of sheet width as one of some stepwise positions.

That is, the sheet detection sensors 19 function as a deviation detector to detect the deviation amount of the sheet P in the direction of sheet width. The deviation amount is the amount of deviation from the correct position of the sheet P in the direction of sheet width. The output of the sheet detection sensors 19 tells how much the sheet P is deviated to the far side or to the near side.

The controller 11 causes the contact pressure changer 183 to change the contact pressing force of the conveyance roller 21A or the conveyance roller 21B according to the detected deviation amount.

Next, the operations in the image forming apparatus in the second embodiment is described.

Figure 12:
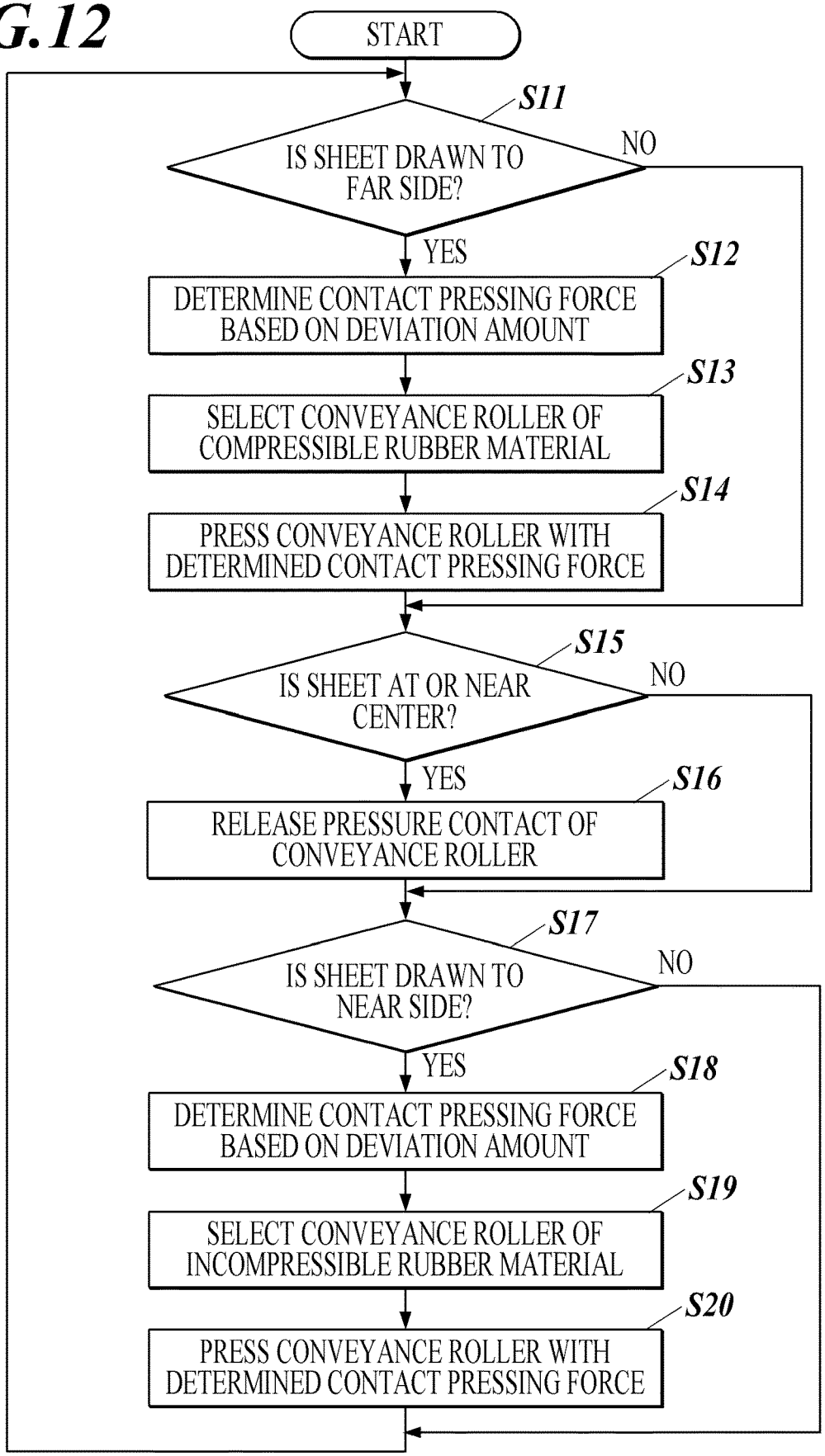
FIG. 12 is a flow chart of the second sheet deviation control processing executed by the image forming apparatus in the second embodiment.

FIG. 12 is a flow chart of the sheet deviation control processing executed by the image forming apparatus in the second embodiment.

First, the controller 11 determines whether or not the sheet is drawn to the far side on the basis of the output of the sheet detection sensors 19 (Step S11).

If the sheet is drawn to the far side (Step S11; YES), the controller 11 determines the deviation amount (extent of deviation to the far side) on the basis of the output of the sheet detection sensors 19. The controller 11 determines the contact pressing force on the basis of the deviation amount (Step S12). Specifically, the controller 11 selects a larger contact pressing force for a larger deviation amount.

Next, the controller 11 controls the roller selector 182 to select the conveyance roller 21B of incompressible rubber material (Step S13).

Next, the controller 11 controls the contact pressure changer 183 to cause the conveyance roller 21B to be pressed with the contact pressing force selected at Step S12 (Step S14). As the conveyance roller 21B is pressed against the facing roller 22B with the determined contact pressing force and the sheet P is conveyed by rotation of the conveyance roller 21B, the sheet P moves toward the near side in the direction of sheet width.

If the sheet is not drawn to the far side after Step S14 or at Step S11 (Step S11; NO), the controller 11 determines whether or not the sheet is at or near the center on the basis of the output of the sheet detection sensors 19 (Step S15).

If the sheet is at or near the center (Step S15; YES), the controller 11 controls the roller selector 182 to release pressure contact of the conveyance rollers 21A and 21B (Step S16).

After performing Step S16 or, if the sheet is not at or near the center at Step S15 (Step S15; NO), the controller 11 determines whether or not the sheet is drawn to the near side on the basis of the output of the sheet detection sensors 19 (Step S17).

If the sheet is drawn to the near side (Step S17; YES), the controller 11 determines the deviation amount (extent of deviation to the near side) on the basis of the output of the sheet detection sensors 19. Then, the controller 11 determines the contact pressing force on the basis of the deviation amount (Step S18). Specifically, the controller 11 selects a larger contact pressing force for a larger deviation amount.

Next, the controller 11 controls the roller selector 182 to select the conveyance roller 21A of incompressible rubber material (Step S19).

Next, the controller 11 controls the contact pressure changer 183 and cause the conveyance roller 21A to be pressed with the contact pressing force determined at Step S18 (Step S20). As the conveyance roller 21A is pressed against the facing roller 22A with the determined contact pressing force and the sheet P is conveyed by rotation of the conveyance roller 21A, the sheet P moves toward the far side in the direction of sheet width.

After performing Step S20, or if the sheet is not drawn to the near side at Step S17 (Step S17; NO), the process is returned to Step S11 and repeated.

As described above, in the second embodiment, in addition to the effects similar to those in the first embodiment, a gap in speed of the sheet P in the direction of sheet width can be generated according to its deviation (how much the sheet P is deviated in the direction of sheet width) as the contact pressing force of the conveyance roller 21A or the conveyance roller 21B to be used is changed on the basis of the deviation amount of the sheet P.

Third Embodiment

Next, the third embodiment of the present invention is described.

The image forming apparatus in the third embodiment is configured similarly to the image forming apparatus 100 in the first embodiment except for the positions of the conveyance rollers 21 used for the sheet deviation control. Thus, the common components are labelled with the same reference signs, and descriptions thereof are omitted. Hereinafter, the configuration and processing specific to the third embodiment are described.

In the first embodiment, the conveyance rollers 21A and 21B which have speed characteristics different from each other are provided at a side end apart from the central part in the direction of sheet width. On the other hand, in the third embodiment, a conveyance roller 21 (first conveyance roller) to increase the speed of the sheet P is arranged on one side and another conveyance roller 21 (second conveyance roller) to decrease the speed of the sheet P is arranged on the other side across the central part in the direction of sheet width.

Figure 13:
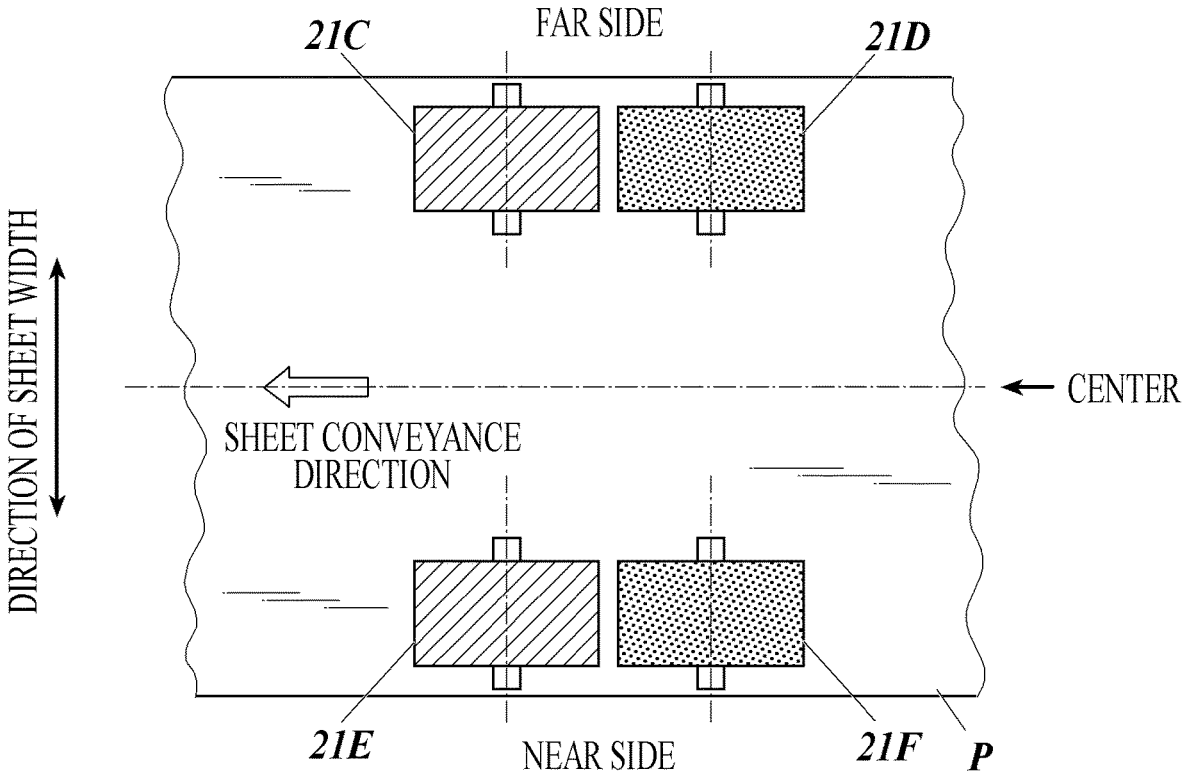
FIG. 13 is a schematic top view of conveyance rollers used for the sheet deviation control of the image forming apparatus in the third embodiment.

FIG. 13 is a schematic top view of the conveyance rollers 21C, 21D, 21E, and 21F used for the sheet deviation control.

The conveyance roller 21C and the conveyance roller 21D are arranged at positions farther than the center in the direction of sheet width on the sheet conveyance path.

The conveyance roller 21C is made of a material (an incompressible rubber material) which causes the sheet P to be conveyed by the conveyance roller 21C in contact therewith at a speed higher than the rotation speed of the conveyance roller 21C.

The conveyance roller 21D is made a material (a compressible rubber material) which causes the sheet P to be conveyed by the conveyance roller 21D in contact therewith at a speed lower than the rotation speed of the conveyance roller 21D.

The conveyance roller 21E and the conveyance roller 21F are arranged at positions nearer than the center in the direction of sheet width on the sheet conveyance path.

The conveyance roller 21E is made of a material (an incompressible rubber material) which causes the sheet P to be conveyed by the conveyance roller 21E in contact therewith at a speed higher than the rotation speed of the conveyance roller 21E.

The conveyance roller 21F is made of a material (a compressible rubber material) which causes the sheet P to be conveyed by the conveyance roller 21F in contact therewith at a speed lower than the rotation speed of the conveyance roller 21F.

The conveyance rollers 21C, 21D, 21E, and 21F respectively faces the facing rollers 22C, 22D, 22E, and 22F, though not shown in the drawings.

The roller selector 182 selects at least one of the conveyance rollers 21C, 21D, 21E, and 21F as a roller(s) to convey the sheet P for the sheet deviation control. The roller selector 182 may cause the conveyance rollers 21C, 21D, 21E, and 21F to be pressed or separated individually.

The controller 11 causes the roller selector 182 to select at least one of the conveyance rollers 21C, 21D, 21E, and 21F on the basis of the position of the sheet P detected by the sheet detection sensors 19A and 19B.

Next, the operations in the image forming apparatus in the third embodiment is described.

Figure 14:
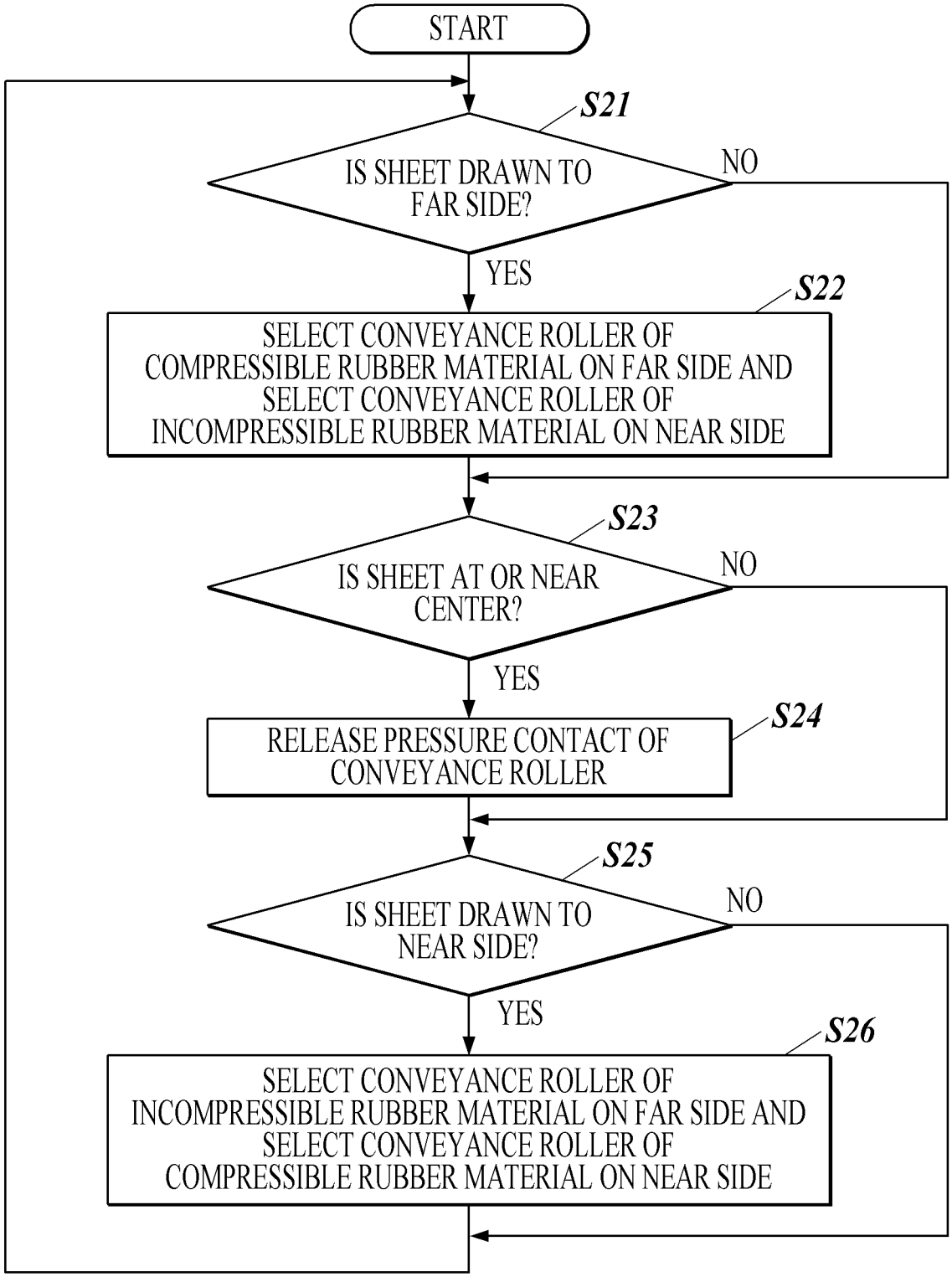
FIG. 14 is a flow chart of the third sheet deviation control processing executed by the image forming apparatus in the third embodiment.

FIG. 14 is a flow chart of the third sheet deviation control processing executed by the image forming apparatus in the third embodiment.

First, the controller 11 determines whether or not the sheet is drawn to the far side on the basis of the output of the sheet detection sensors 19A and 19B (Step S21).

If the sheet is drawn to the far side (Step S21; YES), the controller 11 controls the roller selector 182 to select the conveyance roller 21D of compressible rubber material from the group of the conveyance rollers on the far side (conveyance rollers 21C and 21D) and the conveyance roller 21E of incompressible rubber material from the group of the conveyance rollers on the near side (conveyance rollers 21E and 21F) (Step S22). When the conveyance rollers 21D and 21E are pressed against the facing rollers 22D and 22E and the sheet P is conveyed by rotation of the conveyance rollers 21D and 21E, the sheet conveyance speed is higher on the near side than on the far side, and thus the sheet P moves toward the near side in the direction of sheet width.

After performing Step S22, or if the sheet is not drawn to the far side at Step S21 (Step S21; NO), the controller 11 determines whether or not the sheet is at or near the center on the basis of the output of the sheet detection sensors 19A and 19B (Step S23).

If the sheet is at or near the center (Step S23; YES), the controller 11 controls the roller selector 182 to release pressure contact of the conveyance rollers 21C, 21D, 21E, and 21F (Step S24). Instead of causing the conveyance rollers 21C, 21D, 21E, and 21F to be released, the controller 11 may cause them to be in a slightly pressed state which does not generate a gap in speed in the direction of sheet width. Alternatively, the controller 11 may control the roller selector 182 to select the conveyance rollers 21C and 21E of the same material (with the same speed characteristics) so as not to generate a gap in speed in the direction of sheet width. Similarly, the controller 11 may control the roller selector 182 to select the conveyance rollers 21D and 21F of the same material (with the same speed characteristics) so as not to generate a gap in speed in the direction of sheet width.

After performing Step S24, or if the sheet is not at or near the center at Step S23 (Step S23; NO), the controller 11 determines whether or not the sheet is drawn to the near side on the basis of the output of the sheet detection sensors 19A and 19B (Step S25).

If the sheet is drawn to the near side (Step S25; YES), the controller 11 controls the roller selector 182 to select the conveyance roller 21C of incompressible rubber material from the group of the conveyance rollers on the far side and the conveyance roller 21F of compressible rubber material from the group of the conveyance rollers on the near side (Step S26). When the conveyance rollers 21C and 21F are pressed against the facing rollers 22C and 22F and the sheet P is conveyed by rotation of the conveyance rollers 21C and 21F, the sheet conveyance speed is higher on the far side than on the near side concerning the sheet P (continuous sheet), and thus the sheet P moves toward the far side in the direction of sheet width.

After performing Step S26, or if the sheet is not drawn to the near side at Step S25 (Step S25; NO), the process is returned to Step S21 and repeated.

As described above, in the third embodiment, the group of the conveyance rollers including the conveyance roller 21C of incompressible rubber material and the conveyance roller 21D of compressible rubber material is arranged on one side and the group of the conveyance rollers including the conveyance roller 21E of incompressible rubber material and the conveyance roller 21F of compressible rubber material is arranged on the other side across the center in the direction of sheet width. Thus, the force is dispersedly applied to the sheet P in comparison to the first embodiment. Accordingly, the sheet deviation control can be efficiently executed and damages to the sheet P may be suppressed.

To move the sheet P in the direction of sheet width, the conveyance rollers 21 having speed characteristics different from each other are selected at the opposite ends in the direction of sheet width (the conveyance roller 21C and the conveyance roller 21F, or the conveyance roller 21D and the conveyance roller 21E). However, when it is not necessary to move the sheet Pin the direction of sheet width, as each of the conveyance rollers 21 is independent, the conveyance rollers 21 of the same type (the conveyance roller 21C and the conveyance roller 21E, or the conveyance roller 21D and the conveyance roller 21F) may be selected on the far side and on the near side to be used as regular conveyance rollers which do not generate a gap in speed in the direction of sheet width, advantageously.

Similarly to the first embodiment, either one of the conveyance rollers 21 on one side may be pressed. This can reduce the amount or the speed of movement in the direction of sheet width, compared to a case where the conveyance rollers 21 on the both sides are used.

In the third embodiment, similarly to the second embodiment, it is possible to change how much the surface speed of the conveyance roller 21 at the nip part gets higher or lower by changing the contact pressing force of the conveyance rollers 21. In a case where the surface speed of the conveyance rollers 21 at the nip part is changed by changing the contact pressing force, a gap between the original conveyance speed of the sheet and the surface speed of the conveyance roller 21 is smaller than in a case where a gap in speed of the sheet P in the direction of sheet width is generated by using a brake, etc. Thus, damages on the sheet P may be suppressed, advantageously.

Fourth Embodiment

Next, the fourth embodiment of the present invention is described.

The image forming apparatus in the fourth embodiment is configured similarly to the image forming apparatus 100 in the first embodiment except for the positions of the conveyance rollers 21 used for the sheet deviation control. Thus, the common components are labelled with the same reference signs, and descriptions thereof are omitted. Hereinafter, the configuration and processing specific to the fourth embodiment are described.

In the fourth embodiment, a conveyance roller 21 (first conveyance roller) to increase the speed of the sheet P and another conveyance roller 21 (second conveyance roller) to decrease the speed of the sheet P are arranged on each of the opposite sides across the center in the direction of sheet width, and the conveyance rollers 21 with speed characteristics different from each other rotate on the same axis.

Figure 15:
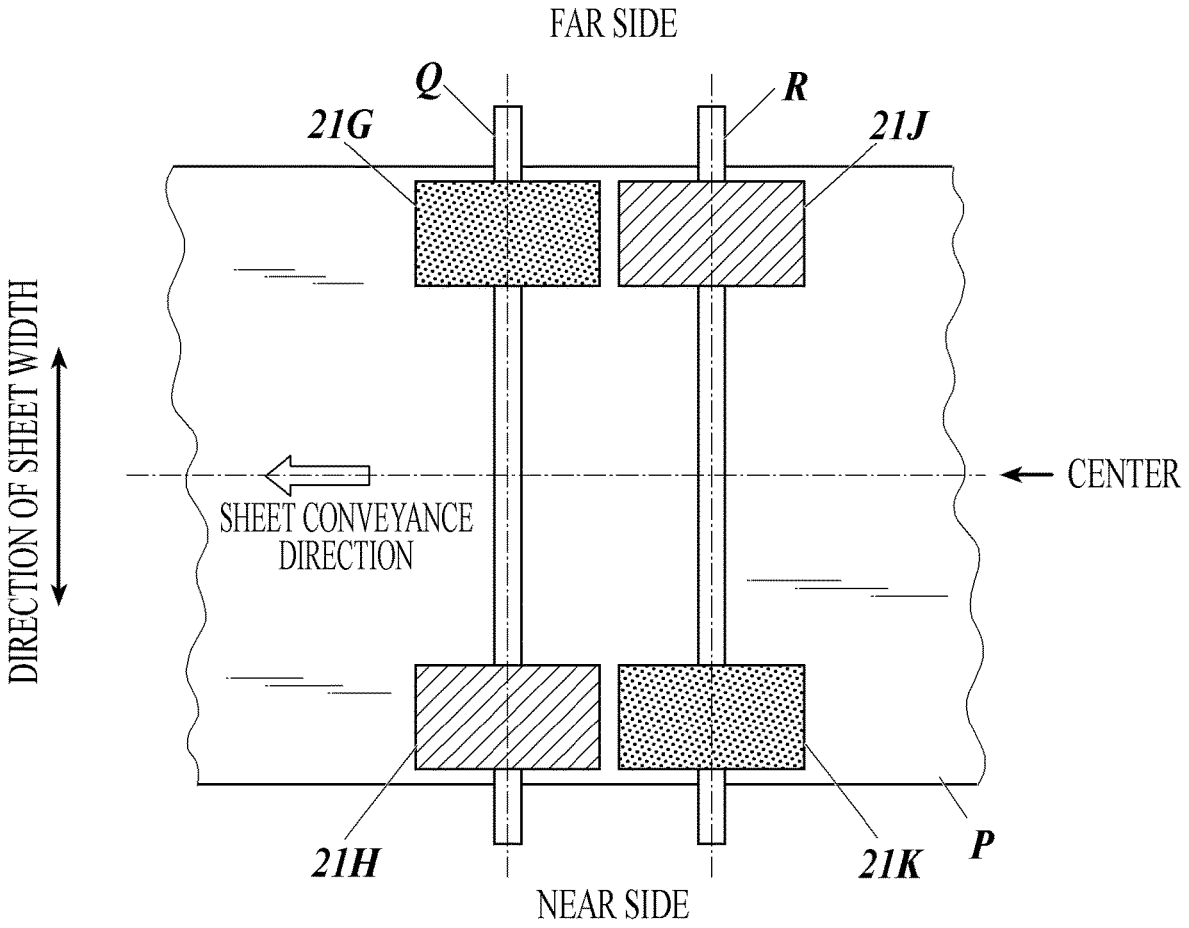
FIG. 15 is a schematic top view of conveyance roller sets used for the sheet deviation control of the image forming apparatus in the fourth embodiment.

FIG. 15 is a schematic top view of conveyance roller sets Q and R used for the sheet deviation control.

The conveyance roller set Q is configured as a conveyance roller 21G and a conveyance roller 21H which rotate on the same axis.

The conveyance roller 21G is made of a material (compressible rubber material) which causes the sheet P to be conveyed by the conveyance roller 21G in contact therewith at a speed lower than the rotation speed of the conveyance roller 21G.

The conveyance roller 21H is made of a material (incompressible rubber material) which causes the sheet P to be conveyed by the conveyance roller 21H in contact therewith at a speed higher than the rotation speed of the conveyance roller 21H.

The conveyance roller set R is configured as the conveyance roller 21J and the conveyance roller 21K which rotate on the same axis.

The conveyance roller 21J is made of a material (incompressible rubber material) which causes the sheet P to be conveyed by the conveyance roller 21J in contact therewith at a speed higher than the rotation speed of the conveyance roller 21J.

The conveyance roller 21K is made of a material (compressible rubber material) which causes the sheet P to be conveyed by the conveyance roller 21K in contact therewith at a speed lower than the rotation speed of the conveyance roller 21K.

The conveyance roller 21G and the conveyance roller 21J are arranged at positions farther than the center in the direction of sheet width on the sheet conveyance path.

The conveyance roller 21H and the conveyance roller 21K are arranged at positions nearer than the center in the direction of sheet width on the sheet conveyance path.

The conveyance roller 21H which is arranged (on one side) at a position nearer than the center in the direction of sheet width and the conveyance roller 21G which is arranged (on the other side) at a position farther than the center in the direction of sheet width are configured to rotate on the same axis.

The conveyance roller 21K which is arranged (on one side) at a position nearer than the center in the direction of sheet width and the conveyance roller 21J which is arranged (on the other side) at a position farther than the center in the direction of sheet width are configured to rotate on the same axis.

The conveyance rollers 21G, 21H, 21J, and 21K respectively faces the facing rollers 22G, 22H, 22J, and 22K, though not shown in the drawings.

The roller selector 182 selects the conveyance roller set Q (the conveyance rollers 21G and 21H) or the conveyance roller set R (the conveyance rollers 21J and 21K) as the rollers to convey the sheet P for the sheet deviation control. The roller selector 182 may cause the conveyance roller sets Q and R to be pressed or separated individually.

The controller 11 causes the roller selector 182 to select the conveyance roller set Q or the conveyance roller set Ron the basis of the position of the sheet P detected by the sheet detection sensors 19A and 19B.

Next, the operations of the image forming apparatus in the fourth embodiment is described.

Figure 16:
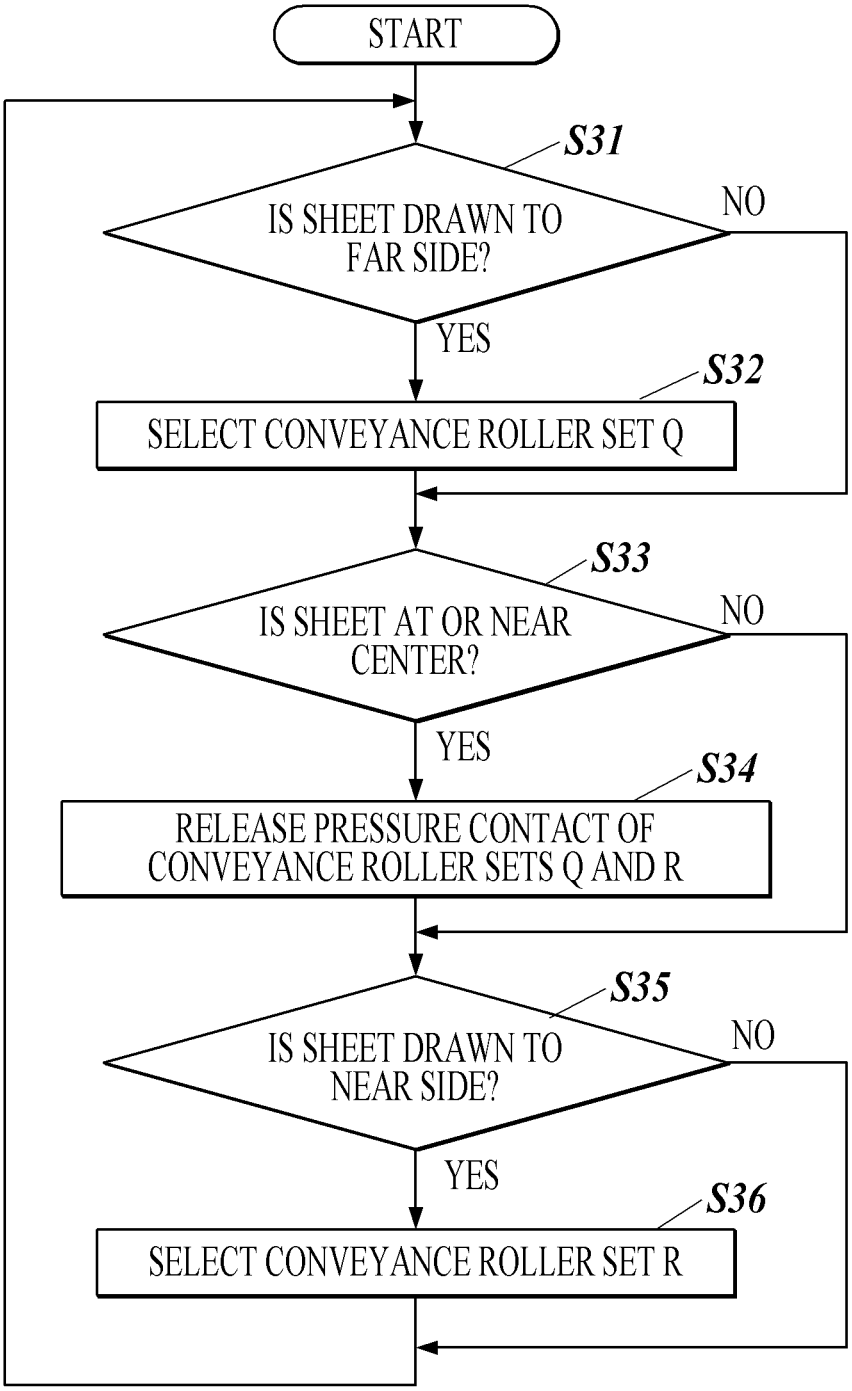
FIG. 16 is a flow chart of the fourth sheet deviation control processing executed by the image forming apparatus in the fourth embodiment.

FIG. 16 is a flow chart of the fourth sheet deviation control processing executed by the image forming apparatus in the fourth embodiment.

The controller 11 first determines whether or not the sheet is drawn to the far side on the basis of the output of the sheet detection sensors 19A and 19B (Step S31).

If the sheet is drawn to the far side (Step S31; YES), the controller 11 controls the roller selector to select the conveyance roller set Q (Step S32). That is, the conveyance roller 21G of compressible rubber material is pressed against the facing roller 22G on the far side, and the conveyance roller 21H of incompressible rubber material is pressed against the facing roller 22H on the near side. When the sheet P is conveyed by rotation of the conveyance rollers 21G and 21H, the sheet conveyance speed is higher on the near side than on the far side, and thus the sheet P moves toward the near side in the direction of sheet width.

After performing Step S32, or if the sheet is drawn to the far side at Step S31 (Step S31; NO), the controller 11 determines whether or not the sheet is at or near the center on the basis of the output of the sheet detection sensors 19A and 19B (Step S33).

If the sheet is at or near the center (Step S33; YES), the controller 11 controls the roller selector 182 to release pressure contact of the conveyance roller sets Q and R (Step S34).

After performing Step S34 or if the sheet is not at or near the center at Step S33 (Step S33; NO), the controller 11 determines whether or not the sheet is drawn to the near side on the basis of the output of the sheet detection sensors 19A and 19B (Step S35).

If the sheet is drawn to the near side (Step S35; YES), the controller 11 controls the roller selector 182 to select the conveyance roller set R (Step S36). That is, the conveyance roller 21J of incompressible rubber material is pressed against the facing roller 22J on the far side, and the conveyance roller 21J of compressible rubber material is pressed against the facing roller 22K on the near side. When the sheet P is conveyed by rotation of the conveyance rollers 21J and 21K, the sheet conveyance speed is higher on the far side than on the near side concerning the sheet P (continuous sheet), and thus the sheet P moves toward the far side in the direction of sheet width.

After performing Step S36, or if the sheet is not drawn to the near side at Step S35 (Step S35; NO), the process is returned to Step S31 and repeated.

Figure 17:
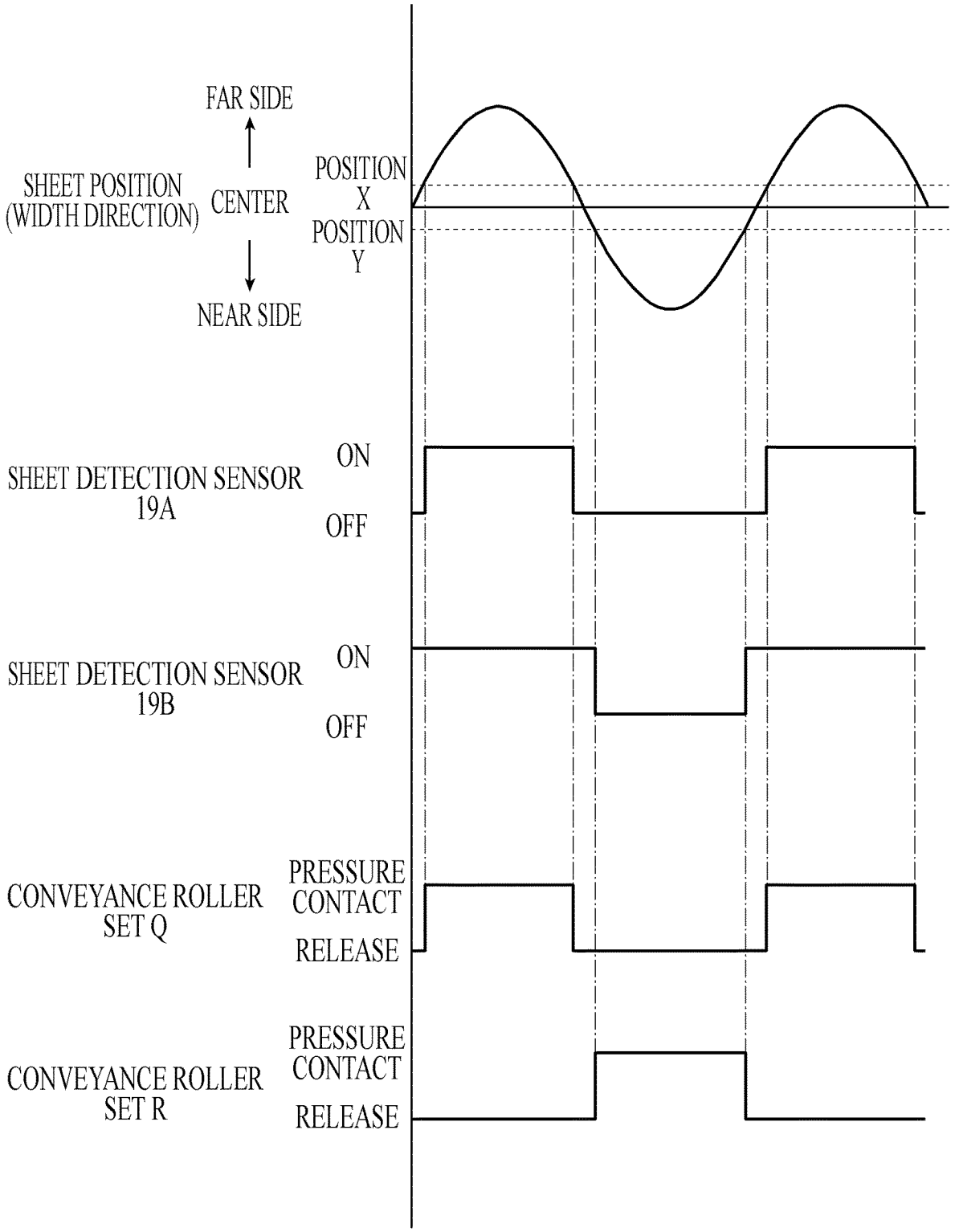
FIG. 17 is a timing chart showing sheet positions, output of the sheet detection sensors, and contact and release of the sets of conveyance rollers.

FIG. 17 is a timing chart showing the sheet position, the output of the sheet detection sensors 19A and 19B, and the contact and release of the conveyance roller sets Q and R. The sheet position X shown in FIG. 17 is where the output of the sheet detection sensor 19A is changed between ON and OFF, and the sheet position Y is where the output of the sheet detection sensor 19B is changed between ON and OFF.

As described above, in the fourth embodiment, the sheet conveyance speed is higher at a part where the conveyance roller 21H conveys the sheet in contact therewith and lower at a part where the conveyance roller 21G conveys the sheet in contact therewith, when an equal contact pressing force is applied to the both edges of the set Q of conveyance rollers which rotate on the same axis. Thus, the conveyance roller set Q does not necessarily have a gap in the contact pressing force between the opposite ends in the direction of sheet width, and the sheet deviation control may be realized by a simple mechanism. The same can be said about the conveyance roller set R.

The conveyance roller set R has speed characteristics contrary to that of the conveyance roller set Q. Thus, the conveyance roller set Q or the conveyance roller set R may be selectively used depending on whether the sheet P is drawn to the far side or to the near side.

In a case where the sheet deviation control is not executed, that is, where the sheet P is simply conveyed, the position of the sheet P in the width direction may not be changed while the conveyance roller sets Q and R may be slightly pressed to keep the conveyance driving force to some extent.

In the fourth embodiment, the conveyance roller sets Q and R are switched between two states, contact and release. However, the contact pressing force may be selected from among three or more levels so that the sheet deviation control may be executed more accurately. The contact pressing force of the conveyance roller sets Q and R may be changed to control how much the surface speed of the conveyance rollers 21 at the nip part is higher or lower, similarly to the second embodiment.

The embodiments described above are merely examples of the sheet conveyance device and the image forming apparatus according to the present invention, and are not intended to limit the scope of the present invention. The specific configurations and detailed operations may be modified within the scope of the present invention.

For example, in the embodiments described above, a continuous sheet is used as the sheet P, though the present invention is applicable to a case where a cut sheet is used. In a case where a cut sheet is used as the sheet P, in comparison to a case where a continuous sheet is used, a gap in speed in the direction of sheet width results in movement of the sheet P in the opposite direction.

Figure 18A:
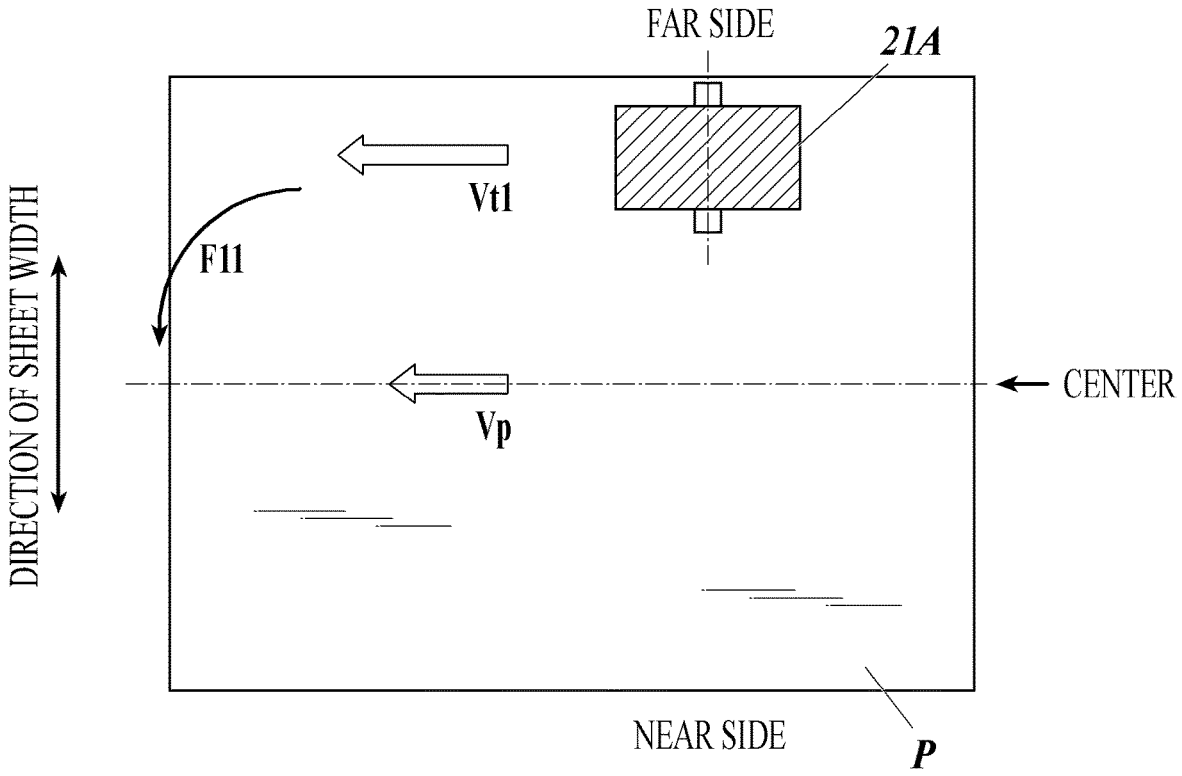
FIG. 18A is an explanatory drawing showing movement of sheet in a case where the conveyance roller of incompressible rubber material on the far side is selected for a cut sheet.

FIG. 18A shows a case where the conveyance roller 21A of incompressible rubber material as described in the first embodiment is selected for a cut sheet. When the rotation driving force which gives a rotation speed Vp to the conveyance roller 21A is applied while the sheet P is being conveyed at a sheet speed Vp, the surface speed Vt1 of the conveyance roller 21A is higher than the speed Vp. A force F 11 to rotate in the left direction acts on the sheet P because of the gap in speed (Vt1>Vp) in the direction of sheet width on the sheet P, and thus the sheet P moves toward the near side.

Figure 18B:
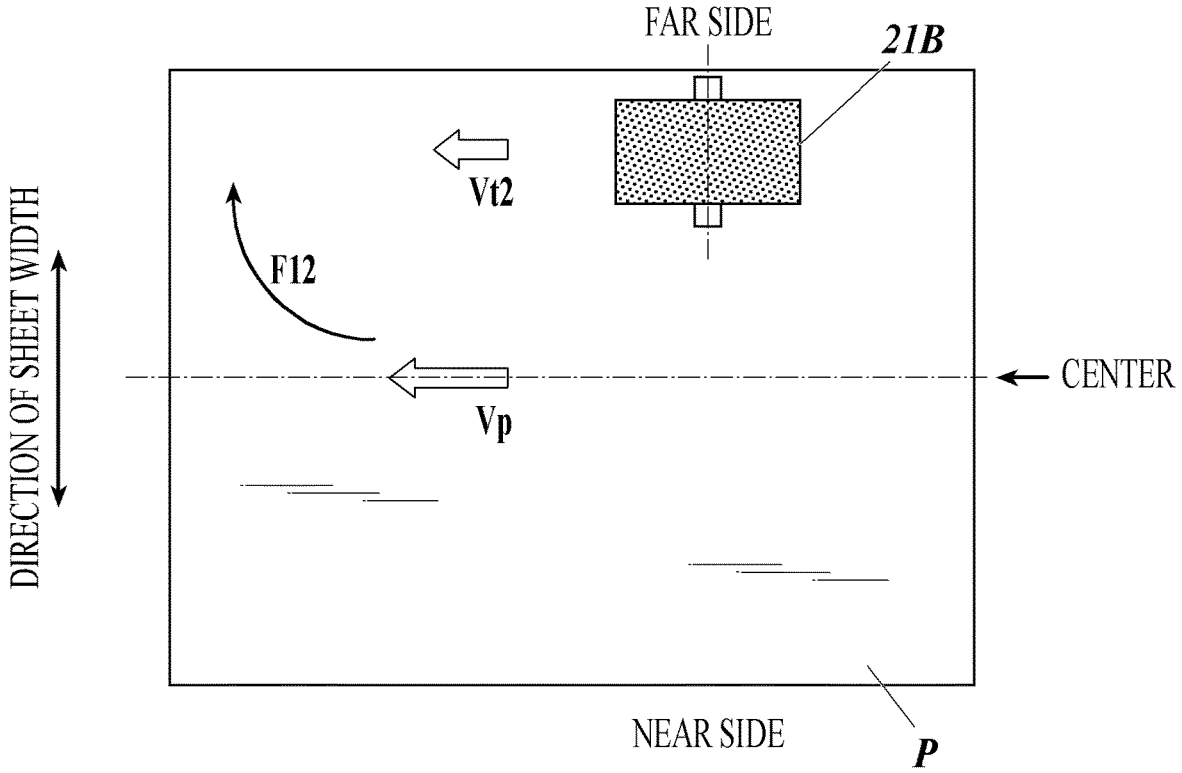
FIG. 18B is an explanatory drawing showing movement of sheet in a case where the conveyance roller of compressible rubber material on the far side is selected for a cut sheet.

FIG. 18B shows a case where the conveyance roller 21B of compressible rubber material as described in the first embodiment is selected for a cut sheet. When the rotation driving force which gives a rotation speed Vp to the conveyance roller 21B is applied while the sheet P is being conveyed at a sheet speed Vp, the surface speed Vt2 of the conveyance roller 21B is lower than the speed Vp. A force F12 to rotate in the right direction acts on the sheet P because of the gap in speed (Vt2<Vp) in the direction of sheet width on the sheet P, and thus the sheet P moves toward the far side.

Figure 19A:
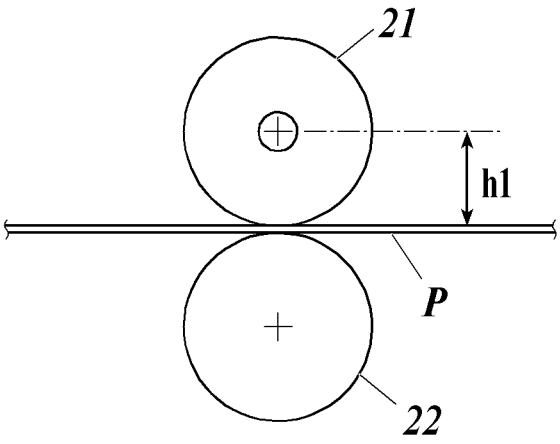
FIGS. 19A and 19B are explanatory drawings showing the amount of shrinking of the conveyance roller.
Figure 19B:
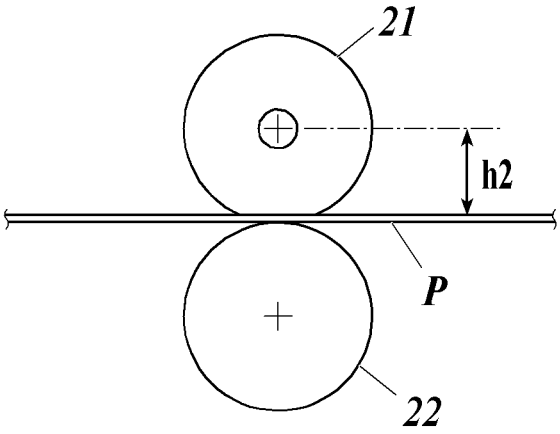

The contact pressing force of the conveyance roller 21 may be adjusted by using the amount of shrinking of the conveyance roller 21, since the contact pressing force of the conveyance roller 21 is more easily controllable at a lower cost than by direct measurement or control of the contact pressing force by the contact pressure changer 183.

Where h1 is a radius of the conveyance roller 21 pressed against the facing roller 22 as shown in FIG. 19A, and h2 is a distance between the center of the roller axis of the conveyance roller 21 and the sheet P as shown in FIG. 19B, the amount h3 of shrinking of the conveyance roller 21 is given by h3=h1−h2. The contact pressing force of the conveyance roller 21 may be simply adjusted by adjustment of the amount h3 of shrinking.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Application No. 2018-194759, filed on Oct. 16, 2018, is incorporated herein by reference in its entirety.

The invention claimed is:

1. A sheet conveyance device, comprising:

a first conveyance roller and a second conveyance roller that are arranged at a position other than a center in a direction of sheet width in a sheet conveyance path;

a roller selector that selects the first conveyance roller or the second conveyance roller as a roller to convey a sheet; and a controller that causes the roller selector to select the first conveyance roller or the second conveyance roller, wherein the first conveyance roller is made of a material that causes a speed of the sheet conveyed by the first conveyance roller in contact with the first conveyance roller to be higher than a rotation speed of the first conveyance roller, and wherein the second conveyance roller is made of a material that causes a speed of the sheet conveyed by the second conveyance roller in contact with the second conveyance roller to be lower than a rotation speed of the second conveyance roller.

2. The sheet conveyance device according to claim 1, further comprising a sheet position detector that detects a position of the sheet in the direction of sheet width, wherein the controller causes the roller selector to select the first conveyance roller or the second conveyance roller based on the detected position of the sheet.

3. The sheet conveyance device according to claim 1, further comprising a contact pressure changer that changes a contact pressing force with which each of the first conveyance roller and the second conveyance roller is pressed against a facing roller.

4. The sheet conveyance device according to claim 1, further comprising a deviation amount detector that detects an amount of deviation of the sheet in the direction of sheet width, wherein the controller causes the contact pressure changer to change a contact pressing force with which each of the first conveyance roller and the second conveyance roller is pressed, based on the detected deviation amount.

5. The sheet conveyance device according to claim 1, wherein the first conveyance roller comprises two first conveyance rollers disposed respectively on opposite sides in the direction of sheet width across the center, and the second conveyance roller comprises two second conveyance rollers disposed respectively on opposite sides in the direction of sheet width across the center.

6. The sheet conveyance device according to claim 5, wherein a first conveyance roller on a first side and a second conveyance roller on a second side are configured to rotate on a same axis, and wherein a second conveyance roller on the first side and a first conveyance roller on the second side are configured to rotate on a same axis.

7. The sheet conveyance device according to claim 1, wherein the first conveyance roller is made of an incompressible material, and wherein the second conveyance roller is made of a compressible material.

8. An image forming apparatus, comprising:

the sheet conveyance device according to claim 1; and an image forming unit that forms an image on the sheet.

* * * * *